US007871075B2

(12) United States Patent
Asaba

(10) Patent No.: US 7,871,075 B2
(45) Date of Patent: Jan. 18, 2011

(54) IMAGE FORMING APPARATUS AND SHEET CONVEYANCE APPARATUS FOR IMPROVING JAM-HANDLING CAPABILITY USING A LEVER ATTACHED TO A ROLLER PAIR

(75) Inventor: Yohichi Asaba, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 706 days.

(21) Appl. No.: 11/503,282

(22) Filed: Aug. 14, 2006

(65) Prior Publication Data

US 2007/0052151 A1 Mar. 8, 2007

(30) Foreign Application Priority Data

Aug. 12, 2005 (JP) ..... 2005-234237
May 22, 2006 (JP) ..... 2006-141284

(51) Int. Cl.
*B65H 5/06* (2006.01)

(52) U.S. Cl. ..... 271/273; 271/225; 271/902

(58) Field of Classification Search ..... 271/272, 271/273, 274, 225, 902
See application file for complete search history.

(56) References Cited

U.S. PATENT DOCUMENTS 3,761,075 A * 9/1973 van Namen ..... 271/274
4,223,886 A * 9/1980 Vogt ..... 271/246
4,908,674 A * 3/1990 Fukano et al. ..... 399/124
5,024,431 A * 6/1991 Shimizu et al. ..... 271/263
5,064,188 A * 11/1991 Nagao et al. ..... 271/301
5,165,677 A * 11/1992 Shinada ..... 271/3.03
5,255,061 A * 10/1993 Matsuura et al. ..... 399/124
5,316,283 A * 5/1994 Tyson et al. ..... 271/114
2003/0108359 A1* 6/2003 Chung ..... 399/124
2005/0100376 A1* 5/2005 Omotani ..... 399/366

FOREIGN PATENT DOCUMENTS

DE 40 38 519 A1 8/1991
DE 4038519 A * 8/1991
JP 62-201749 9/1987
JP 07-295313 11/1995
JP 9-185309 7/1997
JP 2000-147939 5/2000
JP 2000147939 A * 5/2000
JP 2000-327147 11/2000
JP 2004-026494 1/2004
JP 2005-031352 2/2005

* cited by examiner

*Primary Examiner*—Stefanos Karmis
*Assistant Examiner*—Gerald W McClain
(74) *Attorney, Agent, or Firm*—Oblon, Spivak, McClelland, Maier & Neustadt, L.L.P.

(57) ABSTRACT

An image forming apparatus includes a sheet conveyance path, a pair of rollers configured to rotate in a conveyance direction to convey a sheet in the path by holding the sheet, and to reversely rotate in a direction opposite thereto. The reverse rotation is regulated so that the pair of rollers may reversely rotate within a predetermined amount. A sub-unit is releasable from a body of the image forming apparatus.

12 Claims, 14 Drawing Sheets

IMAGE FORMING APPARATUS AND SHEET CONVEYANCE APPARATUS FOR IMPROVING JAM-HANDLING CAPABILITY USING A LEVER ATTACHED TO A ROLLER PAIR

CROSS-REFERENCE TO RELATED APPLICATIONS

This application is based on, and claims priority to, Japanese patent applications, No. JP2005-234237 filed on Aug. 12, 2005, and No. JP2006-141284 filed on May 22, 2006 in the Japan Patent Office, the entire contents of each of which are incorporated by reference herein.

BACKGROUND OF THE INVENTION

1. Field of the Invention

The present invention relates to an image forming apparatus such as a copier and a printer, and a sheet conveyance apparatus, and more particularly to an image forming apparatus for improving jam-handling capability and a sheet conveyance apparatus included therein.

2. Discussion of the Background

Background image forming apparatuses such as copiers, printers, and facsimile machines are provided with an accessible sheet conveyance path arranged in the vicinity of a registration roller so that a jam clearance operation is easily performed. For example, one background image forming apparatus has a configuration in which covers of an automatic duplex apparatus and a secondary transfer unit are opened so that a sheet conveyance path around a pair of registration rollers may be accessed.

When a jammed sheet lies between a position of the pair of registration rollers and a position of an image forming unit, pulling out the jammed sheet toward an upstream side of the pair of registration rollers in a sheet conveyance direction causes an image formed on the jammed sheet with toner, ink, or the like to adhere to the pair of registration rollers, resulting in a stain on the pair of registration rollers. Therefore, the pair of registration rollers is provided with a one-way clutch in a bearing thereof to regulate reverse rotation of the pair of registration rollers so that the jammed sheet cannot be pulled out toward the upstream side of the pair of registration rollers in the sheet conveyance direction.

SUMMARY OF THE INVENTION

This patent specification describes an image forming apparatus having an improved jam-handling capability. In one example, an image forming apparatus includes a sheet conveyance path, a first pair of rollers, and a sub-unit. The first pair of rollers is configured to rotate in a sheet conveyance direction to convey a sheet in the sheet conveyance path by holding the sheet. The first pair of rollers is further configured to reversely rotate in a direction opposite to the sheet conveyance direction. The reverse rotation of the first pair of rollers is regulated so that the first pair of rollers may reversely rotate within a predetermined amount. The sub-unit is configured to be releasable from a body of the image forming apparatus. Releasing the sub-unit from the body causes a part of the sheet conveyance path in the vicinity of the first pair of rollers to open.

This patent specification further describes a sheet conveyance apparatus having an improved jam-handling capability. In one example, a sheet conveyance apparatus includes a sheet conveyance path and a pair of rollers. The pair of rollers is configured to rotate in a sheet conveyance direction to convey a sheet in the sheet conveyance path by holding the sheet. The pair of rollers is further configured to reversely rotate in a direction opposite to the sheet conveyance direction. The reverse rotation of the pair of rollers is regulated so that the pair of rollers may reversely rotate within a predetermined amount.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
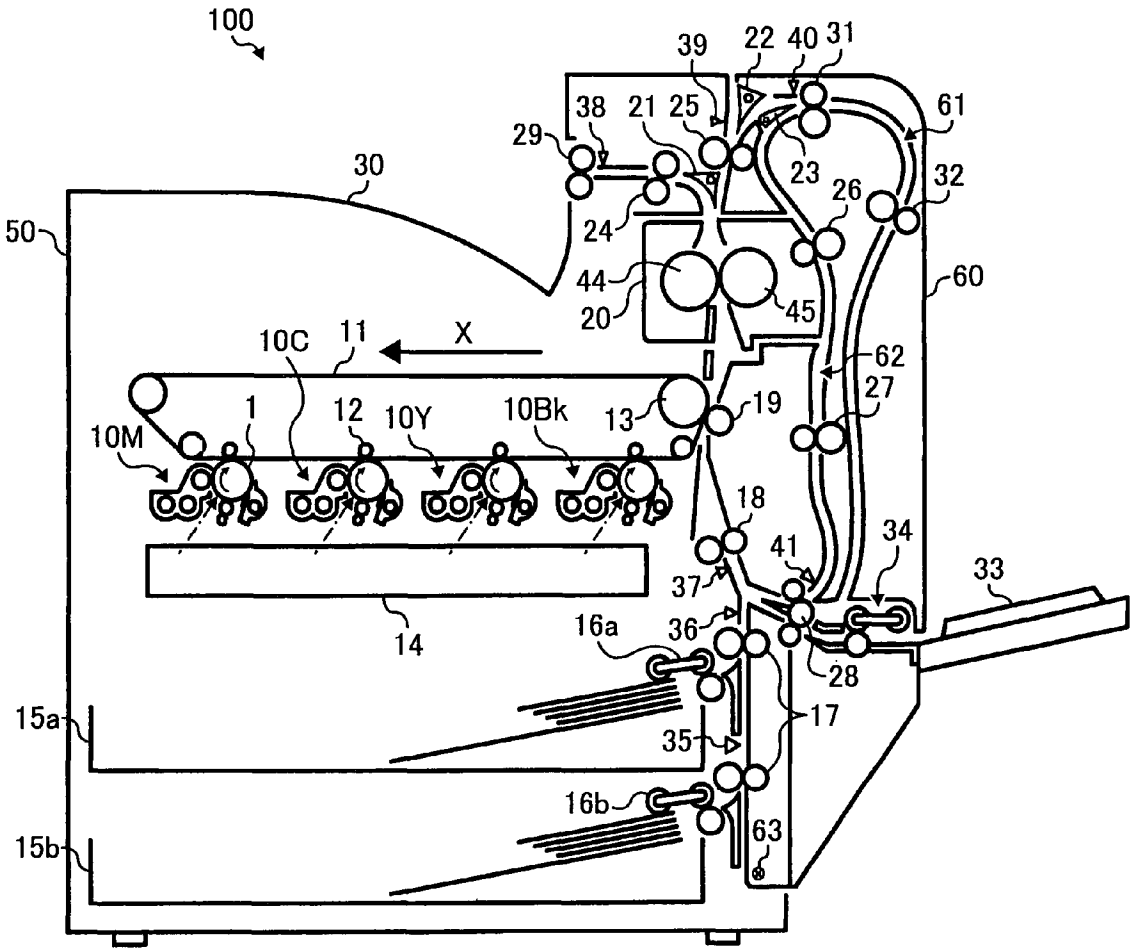
FIG. 1 is a cross section view illustrating an outline of a full color printer according to one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a full color printer according to an exemplary embodiment of the present invention is described.

A general configuration of a full color printer representing an example of an image forming apparatus according to an exemplary embodiment of the present invention is described below.

As shown in FIG. 1, a full color printer 100 includes a body 50. In a central part of the body 50, the full color printer 100 includes an intermediate transfer belt 11 and four image forming units 10M, 10C, 10Y, and 10Bk (collectively referred to as image forming units 10), and an optical writing unit 14. The full color printer 100 further includes a transfer opposing roller 13 and a secondary transfer roller 19. The image forming units 10 include respective photoconductor drums 1 and transfer rollers 12. The image forming units 10 further include respective charge mechanisms, development units, cleaning mechanisms, and so forth arranged around the respective photoconductor drums 1.

In a lower part of the body 50, the full color printer 100 includes sheet feeding cassette 15*a* and 15*b*, two pairs of conveyance rollers 17, a pair of registration rollers 18, and a secondary transfer unit having a secondary transfer mechanism. The sheet feeding cassette 15*a* and 15*b* are provided with sheet feeding mechanisms 16*a* and 16*b*, respectively. Each of the sheet feeding mechanisms 16*a* and 16*b* includes a call roller, a supply roller, and a separation roller.

In an upper part of the body 50, the full color printer 100 includes a fixing unit 20, first, second, third switch pawls 21, 22, and 23, and pairs of conveyance rollers 24, 25, 26, and 27. The full color printer 100 further includes a pair of sheet discharge rollers 29, a sheet discharge tray 30, and sheet sensors 35, 36, 37, 38, 39, 40, and 41. The fixing unit 20 includes a fixing (heating) roller 44 and a pressing roller 45.

In a side part of the body 50, the full color printer 100 includes a sheet re-feeding roller 28, a manual sheet feeding tray 33, a sheet feeding mechanism 34, and a duplex unit 60. The sheet re-feeding roller 28 is provided with two driven rollers. The duplex unit 60 includes a switchback conveyance path 61 and a sheet re-feeding path 62. The duplex unit 60 further includes a pair of first reverse rollers 31, and a pair of second reverse rollers 32. The sheet feeding mechanism 34 includes a call roller, a supply roller, and a separation roller.

In the central part of the body 50, the intermediate transfer belt 11 is wound around a plurality of rollers including the transfer opposing roller 13. The image forming units 10 are arranged along a travel edge on a lower side of the intermediate transfer belt 11. The transfer rollers 12, which serve as a primary transfer mechanism, are provided inside the intermediate transfer belt 11 at respective positions opposing to the respective photoconductor drums 1. In the full color printer 100, the four image forming units 10 share the same configuration except for colors of developers used in the respective development units therein, including magenta, cyan, yellow, and black. In the full color printer 100, the four image forming units 10 are arranged in the order of magenta, cyan, yellow, and black from a left side in FIG. 1. Each of the image forming units 10 is provided as a process cartridge attachable to and detachable from the body 50 of the full color printer 100. The optical writing unit 14 is arranged below the image forming units 10. The optical writing unit 14 includes a polygon mirror and a set of mirrors (not shown), and irradiates surfaces of the photoconductor drums 1 in the respective image forming units 10 with optically modulated laser light. Although the optical writing unit 14 may be individually provided to each of the image forming units 10, sharing the single optical writing unit 14 is advantageous in terms of cost. In the embodiment, the intermediate transfer belt 11 and the optical writing unit 14 are provided as units, and are configured to be attachable to and detachable from the body 50 of the full color printer 100. The secondary transfer roller 19 is located above the pair of registration rollers 18 at a position opposing to the transfer opposing roller 13, and serves as the secondary transfer unit.

In the lower part of the body 50, the sheet feeding cassettes 15*a* and 15*b* are arranged in respective tiers. The pairs of conveyance rollers 17 convey a recording medium such as a transfer sheet (hereinafter referred to as a sheet) fed by the sheet feeding mechanisms 16*a* and 16*b*. Further, the pair of registration rollers 18 is located above the upper one of the pairs of conveyance rollers 17 (located downstream in a sheet conveyance direction).

Figure 2:
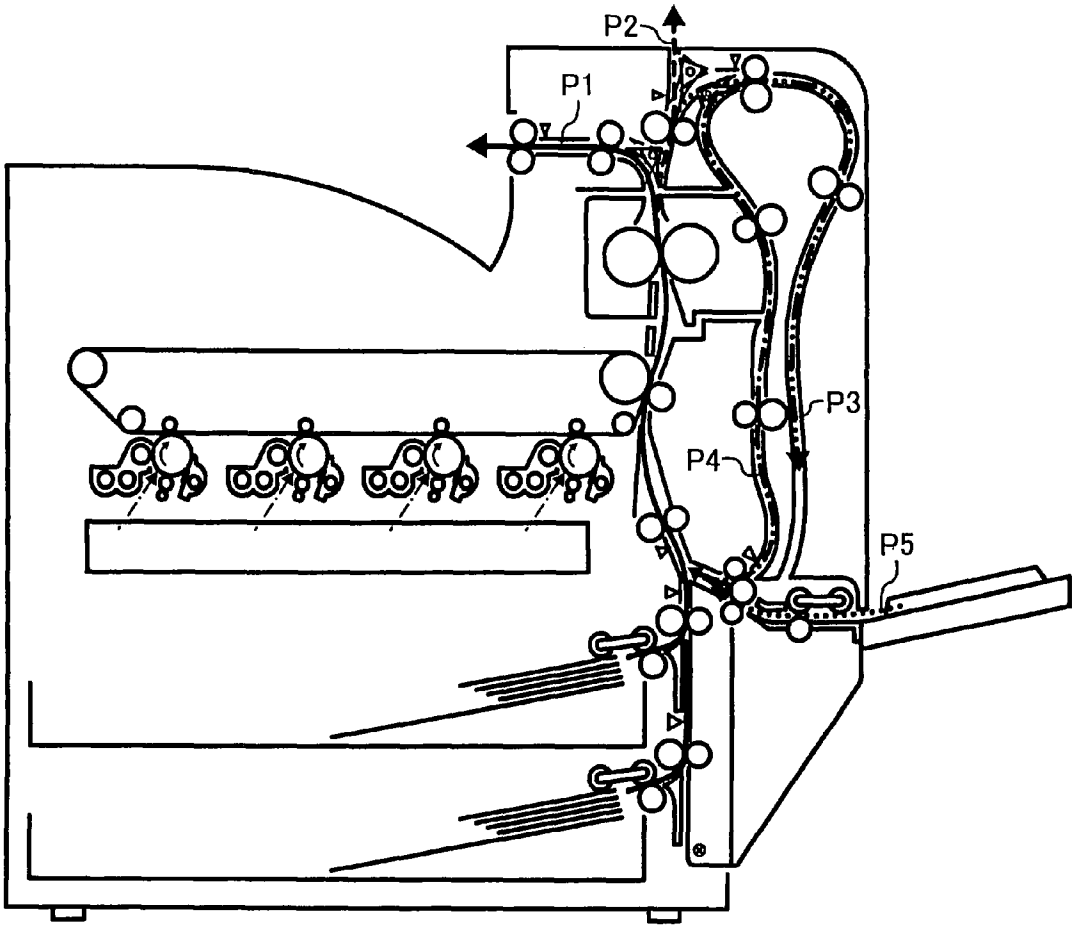
FIG. 2 is an illustration of a sheet conveyance path in the full color printer shown in FIG. 1.

Further, the fixing unit 20 is located above the secondary transfer unit. The first, second, third switch pawls 21 to 23 are arranged above the fixing unit 20, and switch sheet conveyance directions. As shown in FIG. 2 by solid lines and dotted lines, respective positions of the first, second, and third switch pawls 21 to 23 are switched by using respective actuators such as a solenoid actuators (not shown). The pairs of conveyance rollers 24 to 27, and the sheet sensors 35 to 41 are properly arranged on sheet conveyance paths. The sheet conveyance paths are properly guided by guide members such as a guide plate. The sheet discharge tray 30 is formed by an upper face of the body 50. The pair of sheet discharge rollers 29 is located at upper left of the fixing unit 20, and discharges a sheet onto the sheet discharge tray 30.

In the side part of the body 50, the pair of first reverse rollers 31 is located in an entry part of the switchback conveyance path 61 arranged in the upper area of the body 50. The pair of second reverse rollers 32 is located in midstream of the switchback conveyance path 61. The pairs of first and second reverse rollers 31 and 32 are configured to be able to rotate in forward and backward directions. The sheet re-feeding path 62 is substantially trisected by the pairs of conveyance rollers 26 and 27. The third switch pawl 23 is arranged immediately next to the pair of first reverse rollers 31, and is located in an area where a sheet carried out of the switchback conveyance path 61 is conveyed into the sheet re-feeding path 62.

The manual sheet feeding tray 33 is arranged on a side face of the duplex unit 60, and may be pulled out of the duplex unit 60 and be retracted into the duplex unit 60. FIG. 1 shows the full color printer 100 with the manual sheet feeding tray 33 pulled out. The sheet feeding mechanism 34 feeds a sheet from the manual sheet feeding tray 33. The sheet re-feeding roller 28 is medially arranged at a side of the sheet feeding mechanism 34. The driven rollers are press-contacted with upper and lower sides of the sheet re-feeding roller 28. The sheet re-feeding roller 28 is configured to be able to rotate in forward and backward directions. When a sheet is re-fed from the sheet re-feeding path 62, the sheet re-feeding roller 28 is driven to rotate in an anti-clockwise direction in FIG. 1, and when a sheet is fed from the manual sheet feeding tray 33, the sheet re-feeding roller 28 is driven to rotate in a clockwise direction in FIG. 1.

Next, an image forming operation of the full color printer 100 according to the embodiment of the present invention is briefly described below.

The photoconductor drums 1 in the image forming units 10 are driven by a drive mechanism (not shown) to rotate in the clockwise direction, and surfaces of the photoconductor drums 1 are evenly charged by the chargers to a predetermined polarity. The charged surfaces are irradiated with laser light emitted from an optical writing apparatus 14 so as to form respective electrostatic latent images thereon. The laser light represents image information of four colors including magenta, cyan, yellow, and black obtained by separating a desired full color image. The electrostatic latent images are supplied with toner in the respective colors and are visualized as respective toner images by the development units.

The intermediate transfer belt 11 is driven to rotate in the anti-clockwise direction as indicated by an arrow X in FIG. 1. In the image forming units 10, the respective toner images are sequentially transferred from the respective photoconductor drums 1, and are superimposed one after another onto the intermediate transfer belt 11 by action of the transfer rollers 12. As a result, the intermediate transfer belt 11 bears a full color toner image on a surface thereof.

A single color image may be formed by using any one of the image forming units 10. A bicolored or tricolored image may also be formed by using the image forming units 10. In a case of monochrome printing, the image forming unit 10Bk, typically located rightmost among the four image forming units 10 as shown in FIG. 1, is used for image forming.

Residual toner adhering to the surfaces of the photoconductor drums 1 after toner images are transferred is removed from the surfaces by using the cleaning mechanisms. Then, the surfaces are initialized by action of dischargers to prepare for forming a next image.

In the meantime, a sheet is fed from one of the sheet feeding cassettes 15*a* and 15*b*, or the manual sheet feeding tray 33, and is sent out by the pair of registration rollers 18 into a secondary transfer position in synchronization with conveyance of the toner image born on the intermediate transfer belt 11. Since the secondary transfer roller 19 is charged with transfer voltage opposite to a toner charge polarity of the toner image formed on the surface of the intermediate transfer belt 11, the toner image is transferred onto the sheet. When the sheet having the transferred toner image passes by the fixing unit 20, the toner image is molten and fixed to the sheet by heat and pressure. The sheet having the fixed image is discharged by the pair of sheet discharge rollers 29 onto the sheet discharge tray 30. A sheet conveyance path for single-sided image forming (in a case a sheet is fed from one of the sheet feeding cassettes 15*a* and 15*b*) is indicated by a solid line P1 in FIG. 2.

An optional sheet discharge tray may be mounted on the upper face of the full color printer 100 above the second switch pawl 22, and the sheet having the fixed image may be discharged onto the optional sheet discharge tray. An example of the optional sheet discharge tray is a four-bin tray (not shown) having a sort function. A sheet conveyance path for discharging a sheet onto the optional sheet discharge tray (after passing through the fixing unit 20) is indicated by a broken line P2 in FIG. 2.

When double-sided image forming is performed, the positions of the first to third switch pawls 21 to 23 are properly switched so that a sheet having a toner image fixed on one side thereof is conveyed into the switchback conveyance path 61. In this case, the first and second switch pawls 21 and 22 are positioned as indicated by the dotted lines in FIG. 2. The third switch pawl 23 is positioned as indicated by the solid line in FIG. 2. Further, the pairs of first and second reverse rollers 31 and 32 are driven to rotate in the forward direction, in other words, the clockwise direction in FIG. 1. A conveyance path for conveying the sheet into the switchback conveyance path 61 (beyond the pair of conveyance rollers 25) is indicated by a chain double-dashed line P3 in FIG. 2.

When a sensor 40 detects a rear end of the sheet conveyed into the switchback conveyance path 61, the pairs of first and second reverse rollers 31 and 32 are driven to rotate in the backward direction, in other words, the anti-clockwise direction in FIG. 1 so that the sheet is switched back. In the case, the third switch pawl 23 is switched into the position indicated by the dotted line in FIG. 2 so that the switched back sheet is conveyed into the sheet re-feeding path 62.

The sheet re-feeding path 62 meets at a lower end thereof the sheet conveyance path extending from the manual sheet feeding tray 33, and further meets at an opposite side of the sheet re-feeding roller 28 the sheet conveyance path extending from the sheet feeding cassettes 15*a* and 15*b*. The sheet is conveyed in the sheet re-feeding path 62 by the pairs of conveyance rollers 26 and 27, and then toward the pair of registration rollers 18 by the sheet re-feeding roller 28. The sheet conveyance path passing through the sheet re-feeding path 62 (ranging from the third switch pawl 23 to a meeting point with the solid line P1) is indicated by an alternate long and short dashed line P4 in FIG. 2. The sheet conveyance path for feeding a sheet from the manual sheet feeding tray 33 (up to a position beyond the sheet re-feeding roller 28) is indicated by a dashed line P5 in FIG. 2.

The sheet switched back by using the switchback conveyance path 61 is supplied into the sheet re-feeding path 62 so that the sheet is reversed. A toner image is transferred from the intermediate transfer belt 11 onto another side of the sheet, and the transferred image is fixed by the fixing unit 20. The sheet having the images formed on both sides thereof is discharged onto one of the sheet discharge tray 30 and the optional sheet discharge tray to complete double-sided image forming.

Figure 3:
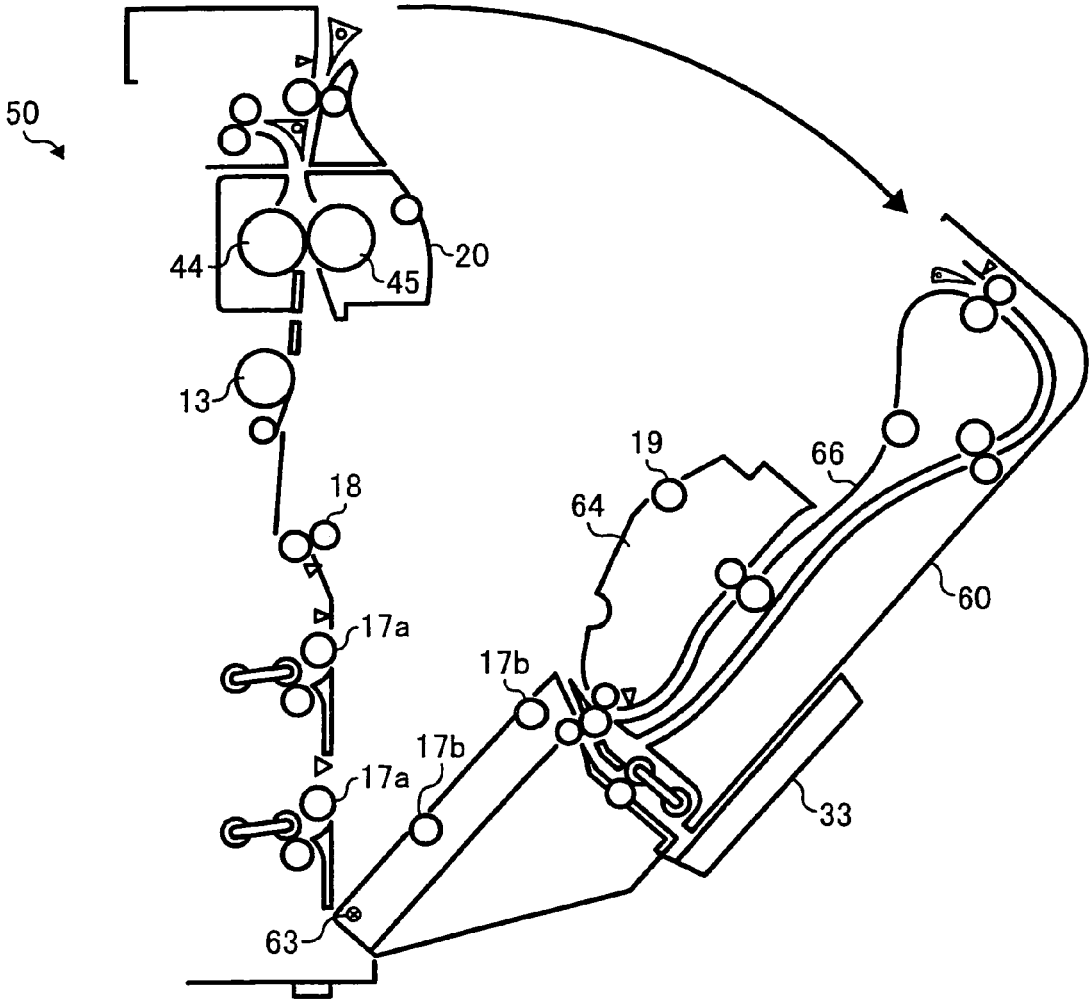
FIG. 3 is an illustration of the full color printer shown in FIG. 1 with a duplex unit opened.

In the full color printer 100 according to the embodiment of the present invention, the duplex unit 60 is pivotable on a pivot 63, and is attached to the body 50 such that the duplex unit 60 may be opened and closed. FIG. 3 illustrates the body 50 of the full color printer 100 with the duplex unit 60 opened. The duplex unit 60 is typically supported by a link mechanism (not shown) of the body 50, and is configured to stop at a predetermined position when opened. Further, a damper mechanism may be suitably provided to the link mechanism supporting the duplex unit 60 so as to reduce force needed for opening and closing the duplex unit 60. The damper mechanism may include a spring, an oil damper, or the like.

The duplex unit 60 includes a guide plate arranged in the switchback conveyance path 61, another guide plate 66 arranged in the sheet re-feeding path 62, a transfer unit 64, the third switch pawl 23, the sheet re-feeding roller 28, the pairs of first and second reverse rollers 31 and 32, the manual sheet feeding tray 33, the sheet feeding mechanism 34 for the manual sheet feeding tray 33, and so forth. The two pairs of conveyance rollers 17 include respective drive rollers 17*a* and respective driven rollers 17*b* as shown in FIG. 3. The driven rollers 17*b* are released from the respective drive rollers 17*a* as the duplex unit 60 is opened.

The pair of registration rollers 18 is supported by a side of the body 50, and remains on the side even when the duplex unit 60 is opened.

When the duplex unit 60 is closed as shown in FIG. 1, the secondary transfer roller 19 is press-contacted with the intermediate transfer belt 11 at the position opposing to the transfer opposing roller 13, and the driven rollers 17*b* are press-contacted with the respective drive rollers 17*a* so that the secondary transfer roller 19 and the two pairs of conveyance rollers 17 are able to function.

When the duplex unit 60 is opened as shown in FIG. 3, the secondary transfer roller 19 is separated from the intermediate transfer belt 11 (and the transfer opposing roller 13), and the driven rollers 17*b* are separated from respective drive rollers 17*a* so that the sheet conveyance path around the pair of registration rollers 18 is opened. In other words, the sheet conveyance path between the lower one of the pairs of conveyance rollers 17 and the pair of registration rollers 18 and the sheet conveyance path between the pair of registration rollers 18 and the fixing unit 20 are opened so that a jam clearance operation may be easily performed.

Figure 4:
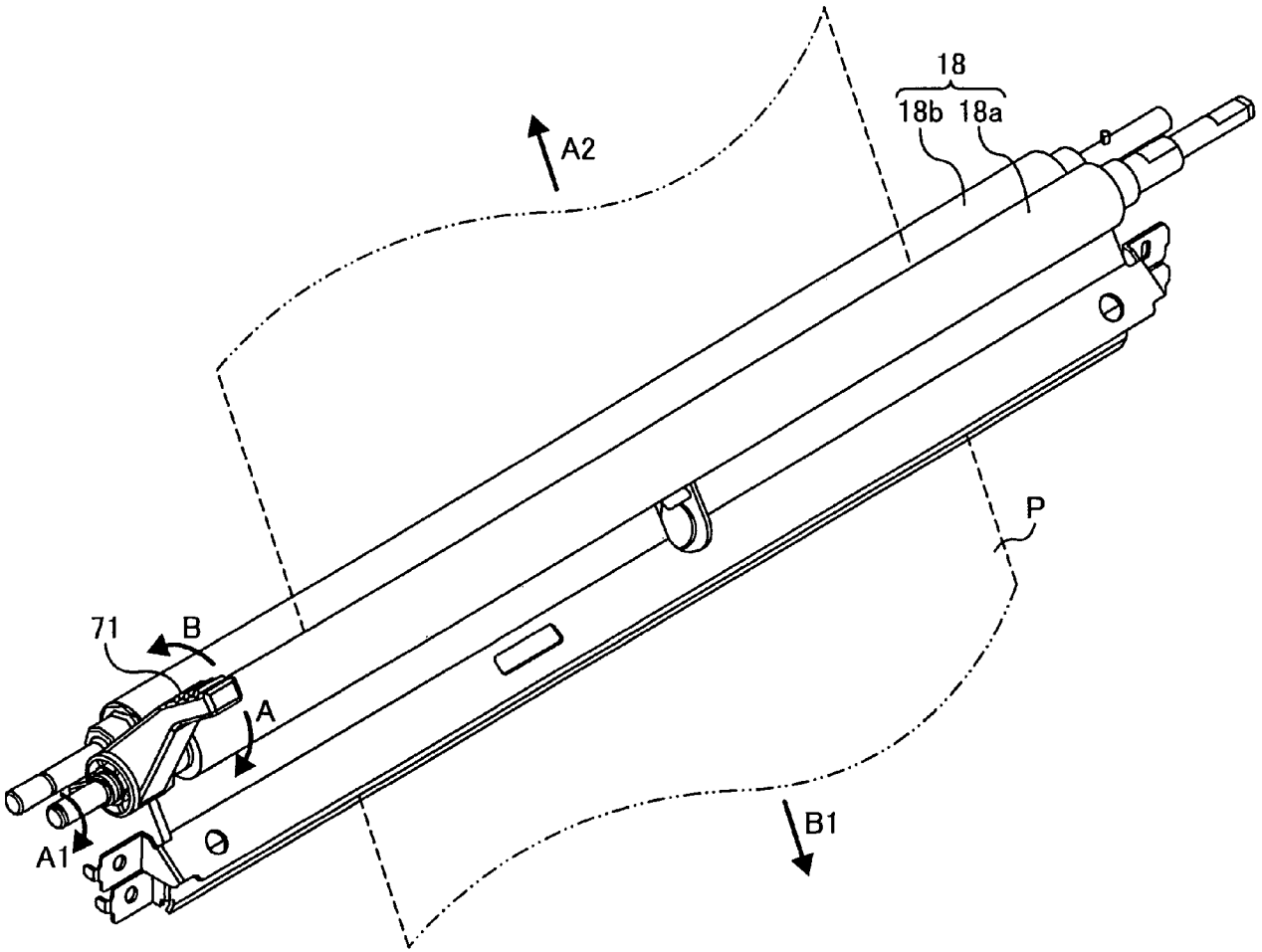
FIG. 4 is a perspective view of a pair of registration rollers and the vicinity thereof included in the full color printer shown in FIG. 1.
Figure 5:
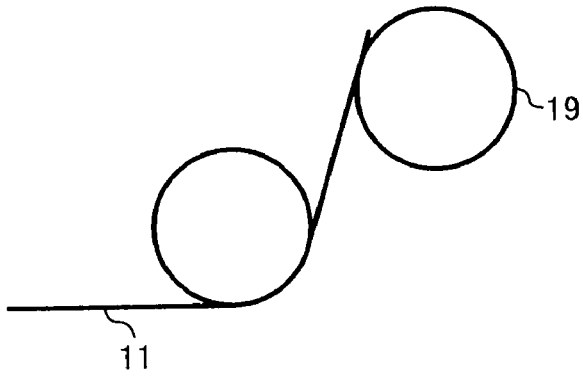
FIG. 5 is a side view of the pair of registration rollers and the vicinity thereof shown in FIG. 4.
Figure 5:
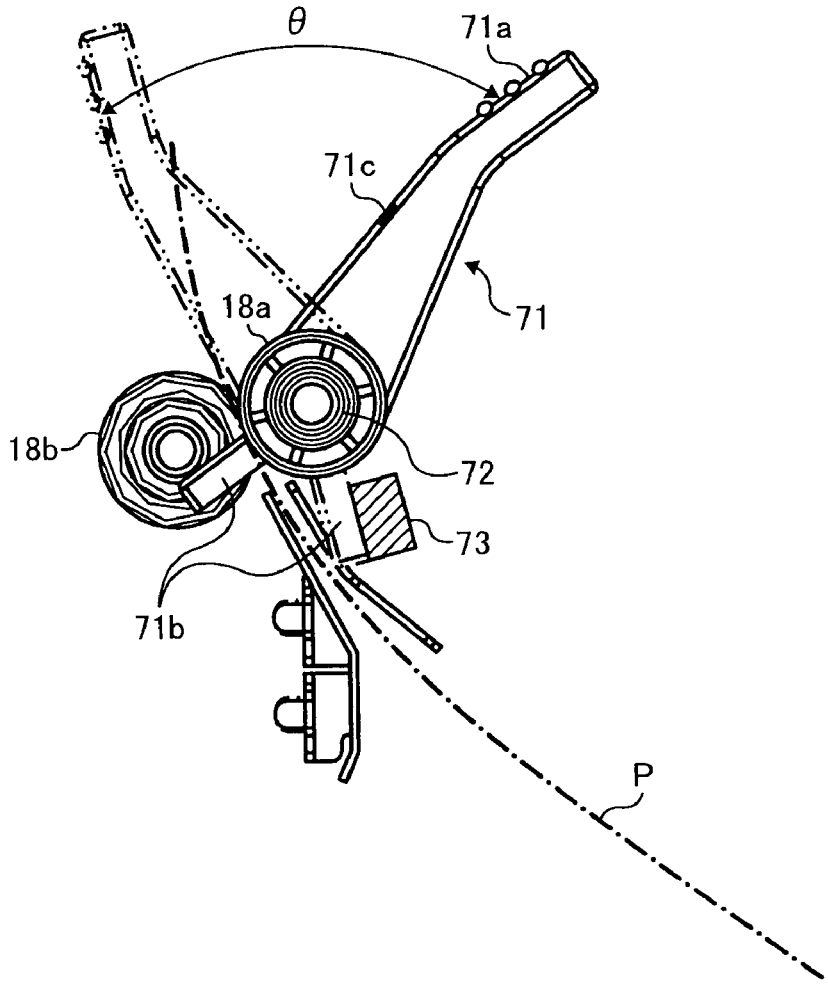

FIGS. 4 and 5 are enlarged views illustrating details of the pair of registration rollers 18 and components located in the vicinity thereof.

As shown in FIGS. 4 and 5, the pair of registration rollers 18 includes a registration drive roller 18*a* and a registration driven roller 18*b*. In the embodiment of the present invention, the registration drive roller 18*a* includes rubber, and the registration driven roller 18*b* includes a rigid body such as a metal. The registration drive roller 18*a* includes a lever 71 inserted into a shaft thereof. The lever 71 includes a grip member 71*a* and an abut member 71*b* provided at an opposite side of the grip member 71*a* in a protruding manner. A one-way clutch 72 is provided between the lever 71 and the shaft so that the registration drive roller 18*a* is able to rotate in a sheet conveyance direction (indicated by an arrow A1 in FIG. 4, which is a clockwise direction in FIG. 5) when the lever 71 is in a fixed state, and is inhibited from rotating in a direction opposite thereto. A regulation member 73 is arranged under and in the vicinity of the registration drive roller 18*a*.

Further, when the lever 71 is rotated in a direction of an arrow A in FIG. 4, the registration drive roller 18*a* rotates in the direction of the arrow A1. On the other hand, when the lever 71 is rotated in a direction of an arrow B in FIG. 4, the lever 71 runs idle against the registration drive roller 18*a*, and the registration drive roller 18*a* is kept stopped. Therefore, repeating action of manually turning the lever 71 in the direction of the arrow A and then in a direction opposite thereto (the direction of the arrow B) conveys a sheet P in the sheet conveyance direction (a direction of an arrow A2). As a result, a front edge of a jammed sheet may be pulled out from the pair of registration rollers 18 to clear a paper jam.

On the other hand, when the registration drive roller 18*a* is rotated in the direction opposite to the direction of the arrow A1 with the lever 71 being in a free state, the lever 71 rotates in the direction of the arrow B.

When the registration drive roller 18*a* is driven in the conveyance direction of the sheet P (the clockwise direction in FIG. 5) while an image forming operation is performed, the abut member 71*b* of the lever 71 abuts on a shaft of the registration driven roller 18*b* as indicated by a solid line in FIG. 5 to inhibit the lever 71 from rotating in a forward direction. The registration drive roller 18*a* in the state rotates in the clockwise direction, and the registration driven roller 18*b* rotates along with the registration drive roller 18*a* in the anti-clockwise direction, and conveys the sheet P in the direction of the arrow A2.

Further, as shown in FIG. 5, the regulation member 73 is located below and in the vicinity of the registration drive roller 18*a*. The regulation member 73 (or reverse rotation regulation member) inhibits the lever 71 from (reversely) rotating in the anti-clockwise direction in FIG. 5 beyond a position of the regulation member 73 as the abut member 71*b* of the lever 71 abuts thereon. Therefore, a rotation range of the lever 71 is regulated by the shaft of the registration driven roller 18*b* and the regulation member 73. In the embodiment of the present invention, the regulation member 73 serves as a reverse rotation regulation member for inhibiting the lever 71 from reversely rotating beyond the position thereof.

When the image forming operation is performed, the lever 71 is in a state indicated by the solid line in FIG. 5, and the registration drive roller 18*a* and the registration driven roller 18*b* rotate in the sheet conveyance direction to convey a sheet. In a case in which the sheet P is jammed while being held by the pair of registration rollers 18 and is stopped, pulling the sheet P toward an upstream side in the sheet conveyance direction (a direction of an arrow B1 in FIG. 4) causes the lever 71 to rotate in the direction of the arrow B in FIG. 4 by the action of the one-way clutch 72 arranged between the lever 71 and the shaft. In a position where the abut member 71*b* of the lever 71 abuts on the regulation member 73 as indicated by chain double-dashed lines in FIG. 5, the lever 71 is inhibited from further rotating. In other words, the pair of registration rollers 18 may reversely rotate (in a direction opposite to the sheet conveyance direction) up to an angle of θ degrees between the positions of the lever 71 indicated by the solid line and chain double-dashed lines. When a force is exerted to reversely rotate the pair of registration rollers 18 beyond the angle of θ degrees, the reverse rotation is inhibited as the abut member 71*b* of the lever 71 abuts the regulation member 73.

Figure 6:
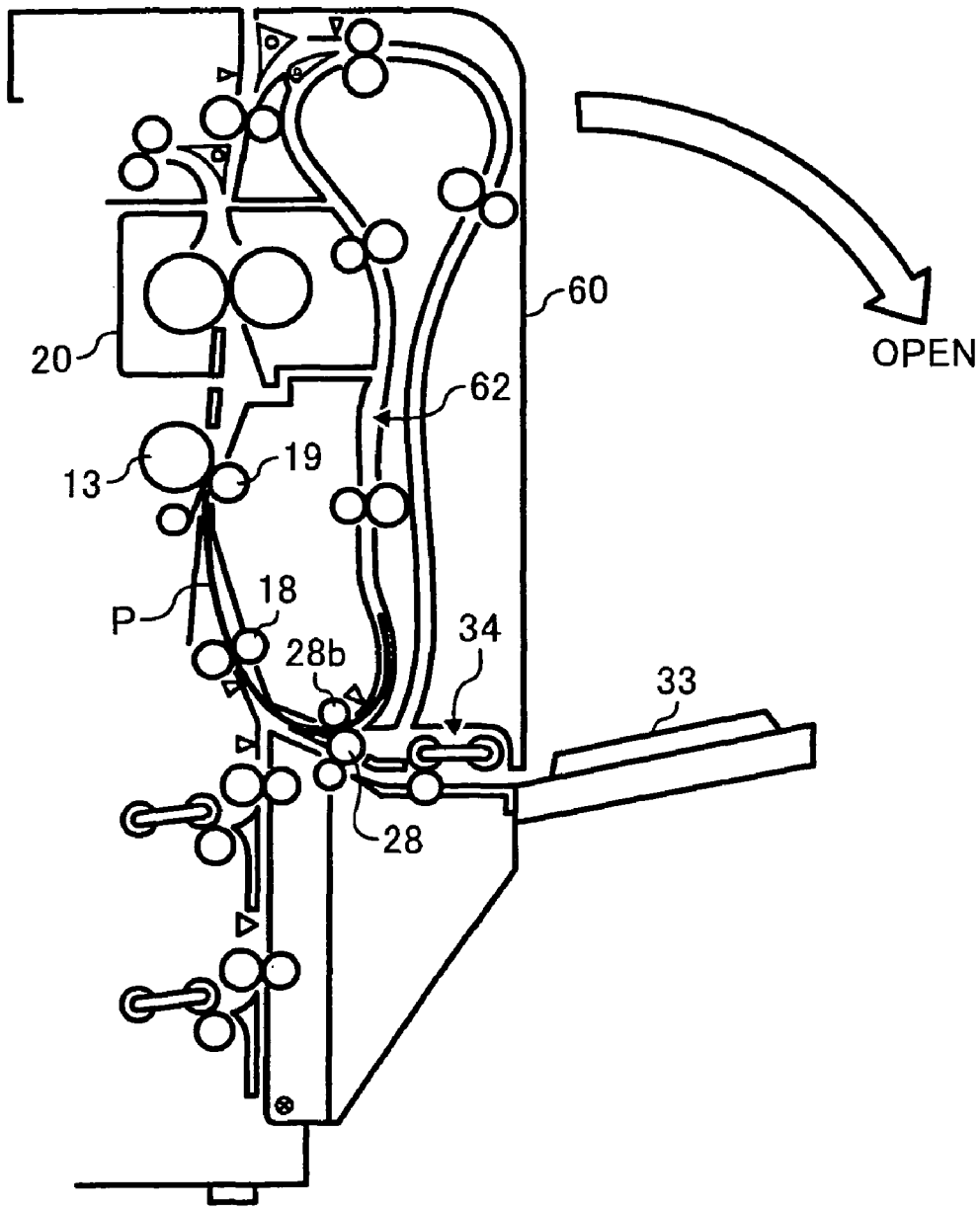
FIG. 6 is a partial cross section view of the duplex unit with a sheet fed from a sheet re-feeding path in a jammed state.

FIG. 6 illustrates a paper jam in which the sheet P is stopped when extending over the sheet re-feeding path 62, the pair of registration rollers 18, and the secondary transfer unit. In the illustrated case, the jammed sheet P is held by the sheet re-feeding roller 28 (and of which upper driven roller 28*b*) and the pair of registration rollers 18.

Figure 7:
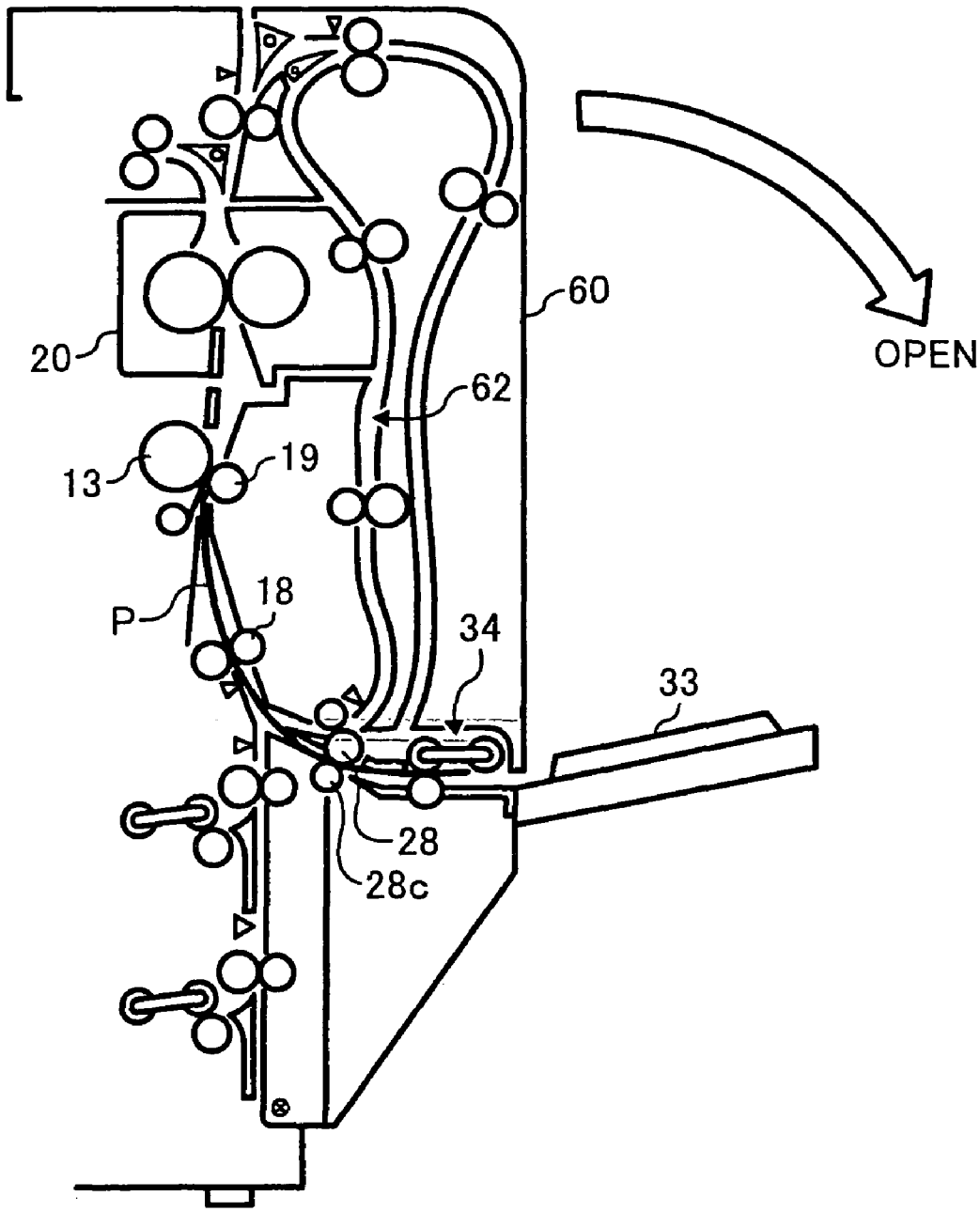
FIG. 7 is another partial cross section view of the duplex unit with a sheet fed from a manual sheet feeding tray in the jammed state.

FIG. 7 illustrates another paper jam in which the sheet P is stopped after being fed from the manual sheet feeding tray 33. In the case illustrated in FIG. 7, the sheet P is held by the sheet re-feeding roller 28 (and lower driven roller 28*c*) and the pair of registration rollers 18 as shown in FIG. 7.

In the cases described above, the duplex unit 60 is opened in a direction indicated by "OPEN" arrows in FIGS. 6 and 7 to perform a jam clearance operation.

Figure 8:
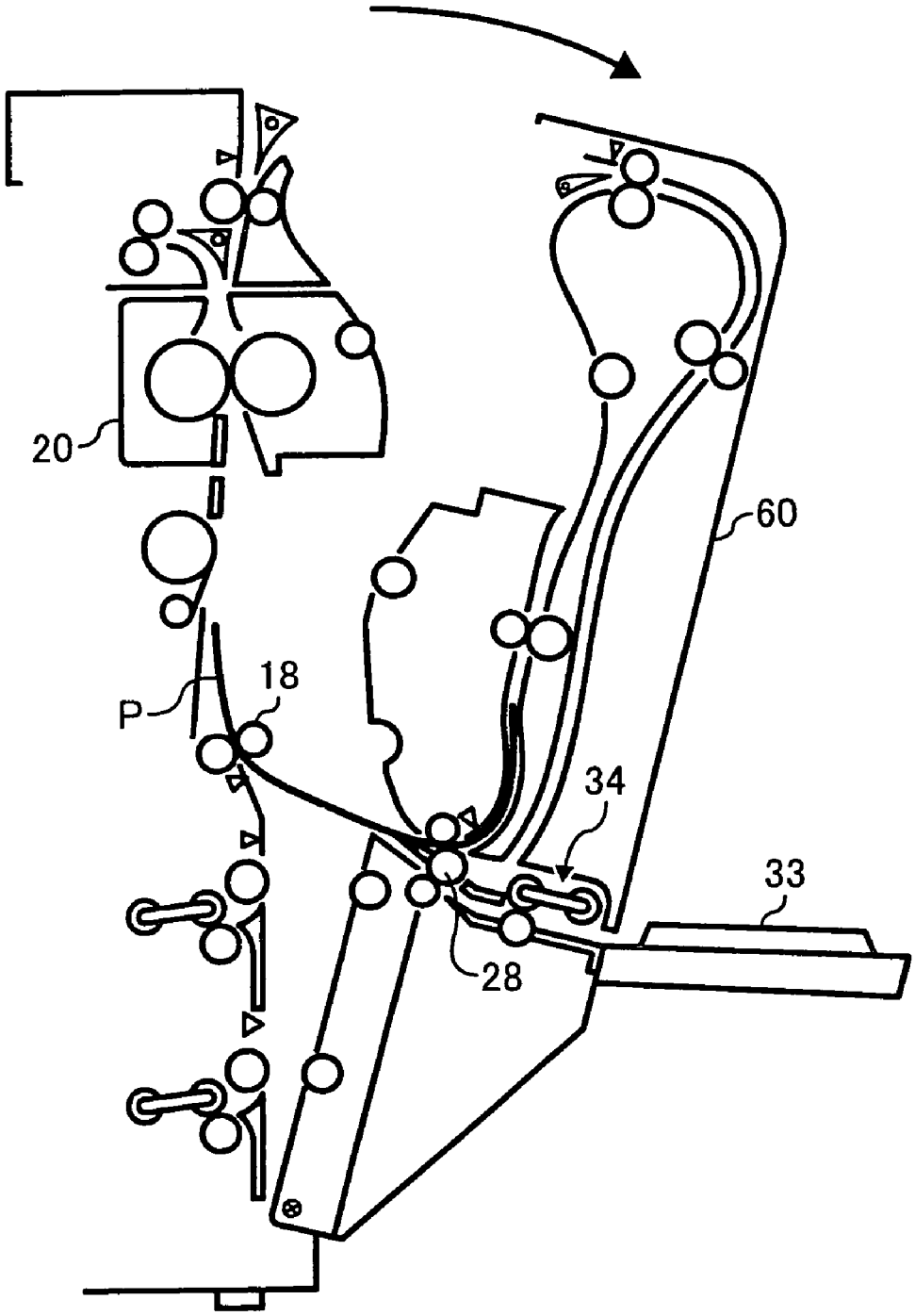
FIG. 8 is another partial cross section view of the duplex unit when a jam clearance operation is performed.

In the embodiment of the present invention, since the pair of registration rollers 18 is allowed to reversely rotate (in the direction opposite to the sheet conveyance direction) by the angle of θ degrees as described above, the pair of registration rollers 18 may reversely rotate at the angle of θ degrees by being pulled by the jammed sheet P held by the sheet re-feeding roller 28 located at a side of the duplex unit 60 when the duplex unit 60 is opened. Therefore, the duplex unit 60 may be easily opened as shown in FIG. 8 to perform the jam clearance operation. In this case, as the pair of registration rollers 18 is allowed to reversely rotate, opening the duplex unit 60 does not require large force, and the jammed sheet P is prevented from being ripped.

Similarly, in a case in which a sheet fed from the manual sheet feeding tray 33 is jammed, the jam clearance operation may be easily performed. The sheet fed from the manual sheet feeding tray 33 may be held by not only the sheet re-feeding roller 28 but also the sheet feeding mechanism 34.

In the embodiment of the presenting invention described above referring to FIG. 5, rotation of the lever 71 is in the direction of the arrow B (see FIG. 4). In other words, reverse rotation of the pair of registration rollers 18, is allowed by the amount of the angle of θ degrees. When L2 represents a distance in which the sheet P is conveyed while the pair of registration rollers 18 reversely rotates at the angel of θ degrees, and D represents a diameter of the pair of the registration rollers 18 (i.e., a diameter of the drive roller 18*a* is equal to a diameter of the driven roller 18*b*), the following equation holds true:

$$L2=\pi*D*\theta/360$$

Figure 9:
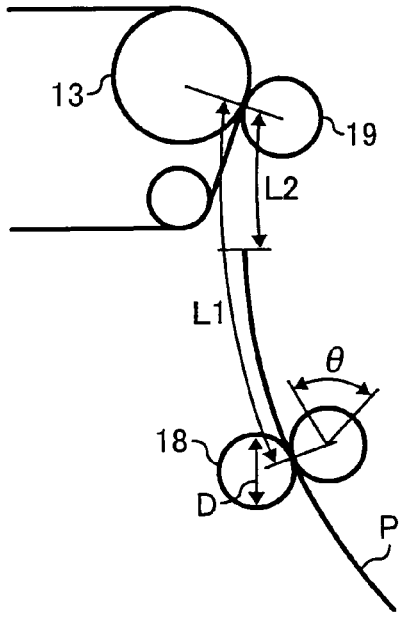
FIG. 9 is a schematic illustration for explaining a distance in which a sheet is moved by reverse rotation of the pair of registration rollers.

In the embodiment of the present invention, as shown in FIG. 9, a distance L1 between the pair of registration rollers 18 and the secondary transfer unit (a press-contact position of the secondary transfer roller 19 with the transfer opposing roller 13) is set to be larger than the distance L2, i.e., (L1>L2). Therefore, when a jammed sheet is pulled in an upstream direction due to the reverse rotation of the pair of registration rollers 18, a part of the jammed sheet positioned in the secondary transfer unit stops at a position downstream of the pair of registration rollers 18. In other words, even when the pair of registration rollers 18 reversely rotates, an image transferred onto the jammed sheet (an unfixed toner image) in the secondary transfer unit does not get through the pair of registration rollers 18, and the jammed sheet stops at the position downstream of the pair of registration rollers 18. As a result, the image transferred onto the jammed sheet is prevented from staining the pair of registration rollers 18.

When jam clearance is performed, the jammed sheet bitten by the pair of registration rollers 18 is pulled downstream in the sheet conveyance direction (upwards in the full color printer 100). In this case, as described above, repeating the action of turning the lever 71 in the direction of the arrow A and then in the direction of the arrow B (see FIG. 4) conveys the sheet P in the sheet conveyance direction (the direction of the arrow A2). Further, in a case in which a front edge of the jammed sheet P extending out of the pair of registration rollers 18 is not long enough to pinch, performing the action described above causes the jammed sheet P to come out. It is preferable in the embodiment to color the lever 71 (in a color indicating user operation), and/or mark (by printing, engraving or using decor) the lever 71 with a sign 71*c* or a number 71*c* indicating a user operation member so that a user may easily understand that the lever 71 is a member that the user needs to operate to clear a jam. Alternatively, an indication may be placed in the vicinity of the lever 71. For example, the sign 71*c* may be placed proximate to the lever, i.e., closer to the lever 71 than to any other component that is used for clearing jams. Such coloration and visual indications are optional.

Further, in the embodiment described above, the lever 71 is arranged on the registration drive roller 18*a* including rubber. Therefore, when the pair of registration rollers 18 is caused to reversely rotate by the jammed sheet P when the duplex unit 60 is opened, a large friction force generated between the sheet P and the registration drive roller 18*a* (the friction force is relatively larger than friction force generated by a roller formed of a rigid body) causes the lever 71 to rotate in the direction of the arrow B so that the abut member 71*b* abuts on the regulation member 73. As a result, the pair of registration rollers 18 is prevented from reversely rotating any further. Therefore, the pair of registration rollers 18 is prevented from being stained. Further, when the lever 71 is rotated in the direction of the arrow A during the jam clearance operation, the front edge of the jammed sheet may come out and be conveyed in the downstream direction as the sheet P is conveyed in the direction of the arrow A2. Alternatively, the lever 71 may be arranged on the registration driven roller 18*b*.

Figure 10:
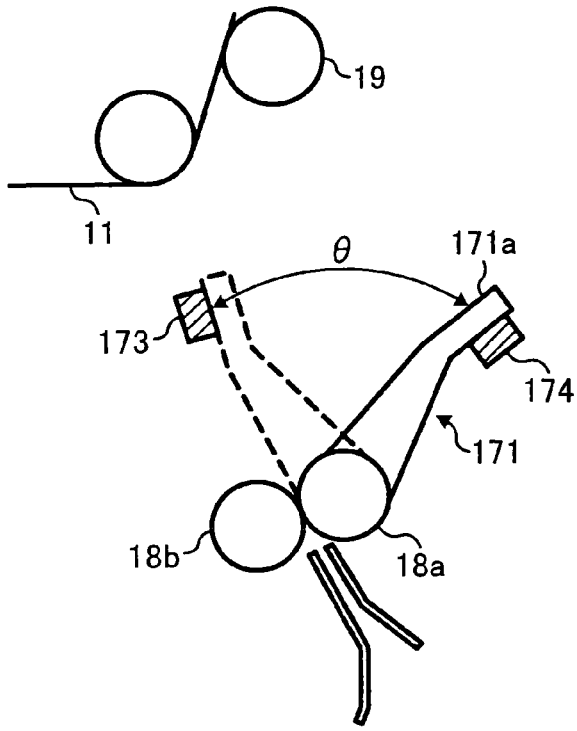
FIG. 10 is a schematic illustration of another example of a configuration for regulating an amount of reverse rotation of the pair of registration rollers.

FIG. 10 illustrates another example of a configuration for regulating an amount of reverse rotation of the pair of registration rollers 18. A lever 171 shown in FIG. 10 does not include the abut member 71*b* included in the lever 71. A first regulation member 173 is arranged above the pair of registration rollers 18, and a second regulation member 174 is arranged at an upper-right position thereof in FIG. 10. As a grip member 171*a* of the lever 171 abuts on the first and second regulation members 173 and 174, a rotation range of the lever 171, in other words, the amount of reverse rotation of the pair of registration rollers 18 is regulated.

In the above embodiment, the levers 71 and 171 are arranged upward so that the rotation ranges of the levers 71 and 171 are located above the pair of registration rollers 18. Alternatively, the levers 71 and 171 may be arranged downward so that the rotation ranges of the levers 71 and 171 are located below the pair of registration rollers 18. Alternatively, the levers 71 and 171 may be laterally arranged so that the rotation ranges of the levers 71 and 171 are located on a side of pair of registration rollers 18. The rotation ranges of the levers 71 and 171 may be appropriately set. Further, the rotation angle θ of the levers 71 and 171, in other words, the amount of reverse rotation of the pair of registration rollers 18 may be appropriately set by a maintenance person or qualified operator.

Figure 11A:
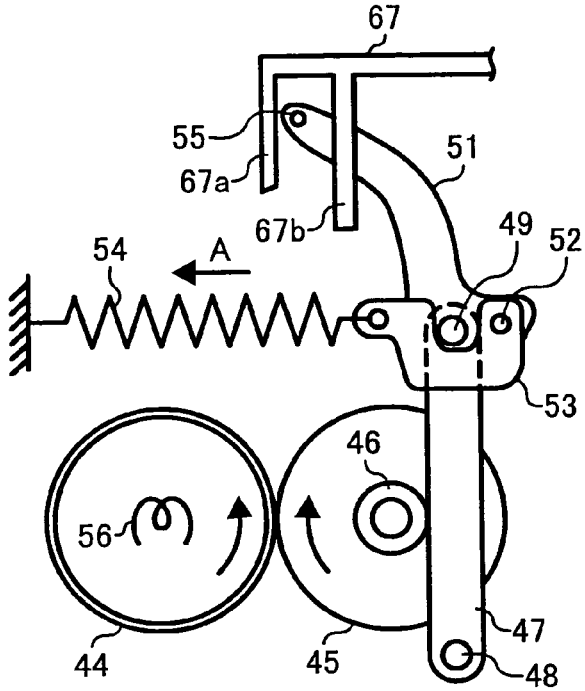
FIG. 11A is a schematic illustration of a fixing unit of the full color printer shown in FIG. 1.
Figure 11B:
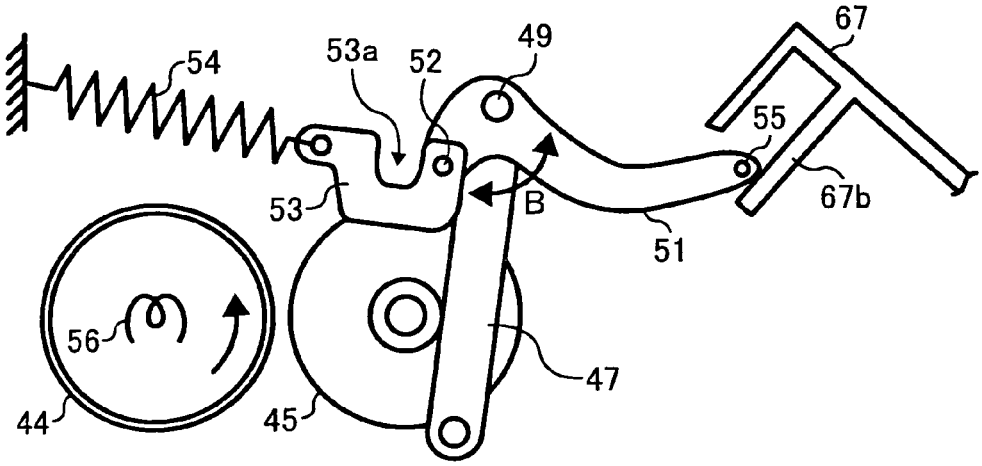
FIG. 11B is another schematic illustration of the fixing unit shown in FIG. 11A.

FIGS. 11A and 11B illustrate a main configuration of the fixing unit 20. As shown in FIGS. 11A and 11B, the fixing unit 20 includes the fixing roller 44, the pressing roller 45, a bearing 46, a pressing lever 47, an axis 48, an axis 49, a pressure release lever 51, and an axis 52. The fixing unit 20 further includes a lock member 53 having a concave member 53*a*, a tension coil spring 54, a pin 55, a halogen heater 56, and a hook member 67 having two arms 67*a* and 67*b*.

The pressing lever 47 presses the pressing roller 45 toward the fixing roller 44. The pressure release lever 51 is rotationally supported by the axis 49 against the pressing lever 47. The lock member 53 is rotationally attached to the pressure release lever 51 by the axis 52. One end of the tension coil spring 54 is engaged with the lock member 53, and the other end of the tension coil spring 54 is engaged with a housing (not shown) of the fixing unit 20. The tension coil spring 54 serves as an elastic member pulling the lock member 53 in a lock direction indicated by an arrow A.

The image forming apparatus according to the embodiment is configured such that press-contact of the pressing roller 45 with the fixing roller 44 is released when the duplex unit 60 is opened. The fixing unit 20 is configured such that a position of the lock member 53 is shifted between a pressing position in which the pressing roller 45 presses the fixing roller 44 through the pressing lever 47 and a pressure release position in which the pressing roller 45 is estranged from the fixing roller 44 by rotating the pressure release lever 51 through the hook member 67 attached to the duplex unit 60. A lower end of the pressing lever 47 is rotationally supported by the axis 48 on a side plate (not shown), and the bearing 46 of the pressing roller 45 is pressed due to force applied by the tension coil spring 54 so that the pressing roller 45 is press-contacted with the fixing roller 44.

As described above, since the lock member 53 is mounted to the pressure release lever 51 so as to swing on the axis 52, and the pressure release lever 51 is mounted on the pressing lever 47 so as to swing on the axis 49, when the pressure release lever 51 rotates, the lock member 53 moves as shown by an dotted arrow B in FIG. 11B.

In FIG. 11A, the pressure release lever 51 is in a lock position. When the pressure release lever 51 is in the lock position, the axis 49 is placed in the concave member 53*a* of the lock member 53 so as to hold the lock member 53 and the pressing lever 47 in the lock position. In FIG. 11B, the pressure release lever 51 is in a release position. When the pressure release lever 51 rotates from the lock position shown in FIG. 11A to the release position shown in FIG. 11B, the axis 52 causes the lock member 53 to rotate while pressing down one end of the lock member 53 so that the concave member 53*a* comes off the axis 49, and the lock member 53 moves into the release position shown in FIG. 11B. As a result, the lock member 53 and the pressing lever 47 are released from the lock position, and the pressing roller 45 moves away from the fixing roller 44 and into the release position shown in FIG. 11B.

On the other hand, when the pressure release lever 51 rotates from the release position shown in FIG. 11B to the lock position shown in FIG. 11A, the lock member 53 rotates by being pulled by the axis 52, and the concave member 53*a* of the lock member 53 is moved to a pressing position shown in FIG. 11A, in which the concave member 53*a* of the lock member 53 is engaged with the axis 49.

In the example, the hook member 67 causes the pressure release lever 51 to rotate. The two arms 67*a* and 67*b* of the hook member 67 are arranged at a front end of the hook member 67. The arm 67*a* is located at an outer position, and the arm 67*b* is located at an inner position. The pin 55 is formed in a protruding manner at a front end of the pressure release lever 51, and is located between the two arms 67*a* and 67*b*. In FIG. 11A, the hook member 67 is in a closed state. In FIG. 11B, the hook member 67 is in an open state. As the duplex unit 60 is opened and closed, the hook member 67 rotates and shifts between the closed state and the open state. In detail, when the duplex unit 60 is opened, the arm 67*a* of the hook member 67 rotates while pressing the pin 55 so as to cause the pressure release lever 51 to rotate in the clockwise direction. On the other hand, when the duplex unit 60 is closed, the arm 67*b* of the hook member 67 rotates while pressing the pin 55 so as to cause the pressure release lever 51 to rotate in the anti-clockwise direction. As described above, as the hook member 67 causes the pressure release lever 51 to rotate in conjunction with opening and closing of the duplex unit 60, the pressing roller 45 press-contacts with the fixing roller 44 when the duplex unit 60 is closed, and the press-contact of the pressing roller 45 with the fixing roller 44 is released when the duplex unit 60 is opened.

Alternatively, the fixing unit 20 may be configured such that a user is asked to manually rotate the pressure release lever 51 after the duplex unit 60 is opened. Further, any other configuration may be provided so as to perform a pressing operation and a pressure releasing operation in a fixing unit in conjunction with opening and closing of the duplex unit 60.

Further, in the example, the fixing roller 44 internally includes the halogen heater 56 which serves as a heat source. Alternatively, a heat source may be externally provided to a fixing roller. Further, induction heating and any other heating method may be adopted. Further, a belt fixing method may also be adopted.

As described in the above example, as press-contact of the pressing roller 45 with the fixing roller 44 in the fixing unit 20 is released when the duplex unit 60 is opened, even when a jammed sheet is held by the fixing roller 44 and the pressing roller 45, the jammed sheet may be easily removed, and the jam clearance operation may be facilitated.

Figure 12:
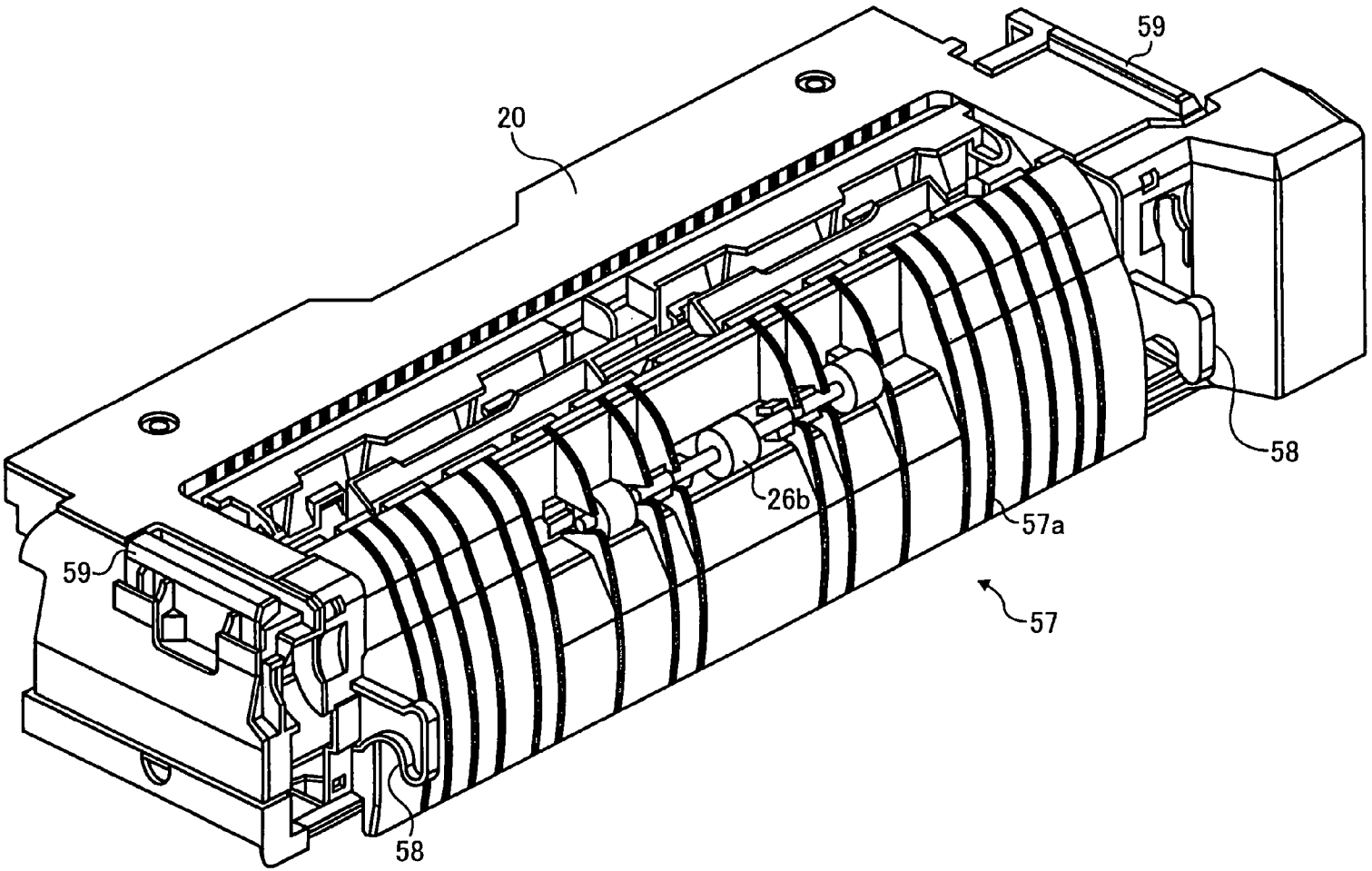
FIG. 12 is a perspective view of the fixing unit viewed from a side of the sheet re-feeding path.

FIG. 12 is a perspective view of a non-limiting example of the fixing unit 20, viewed from a side of the sheet re-feeding path 62.

Figure 13:
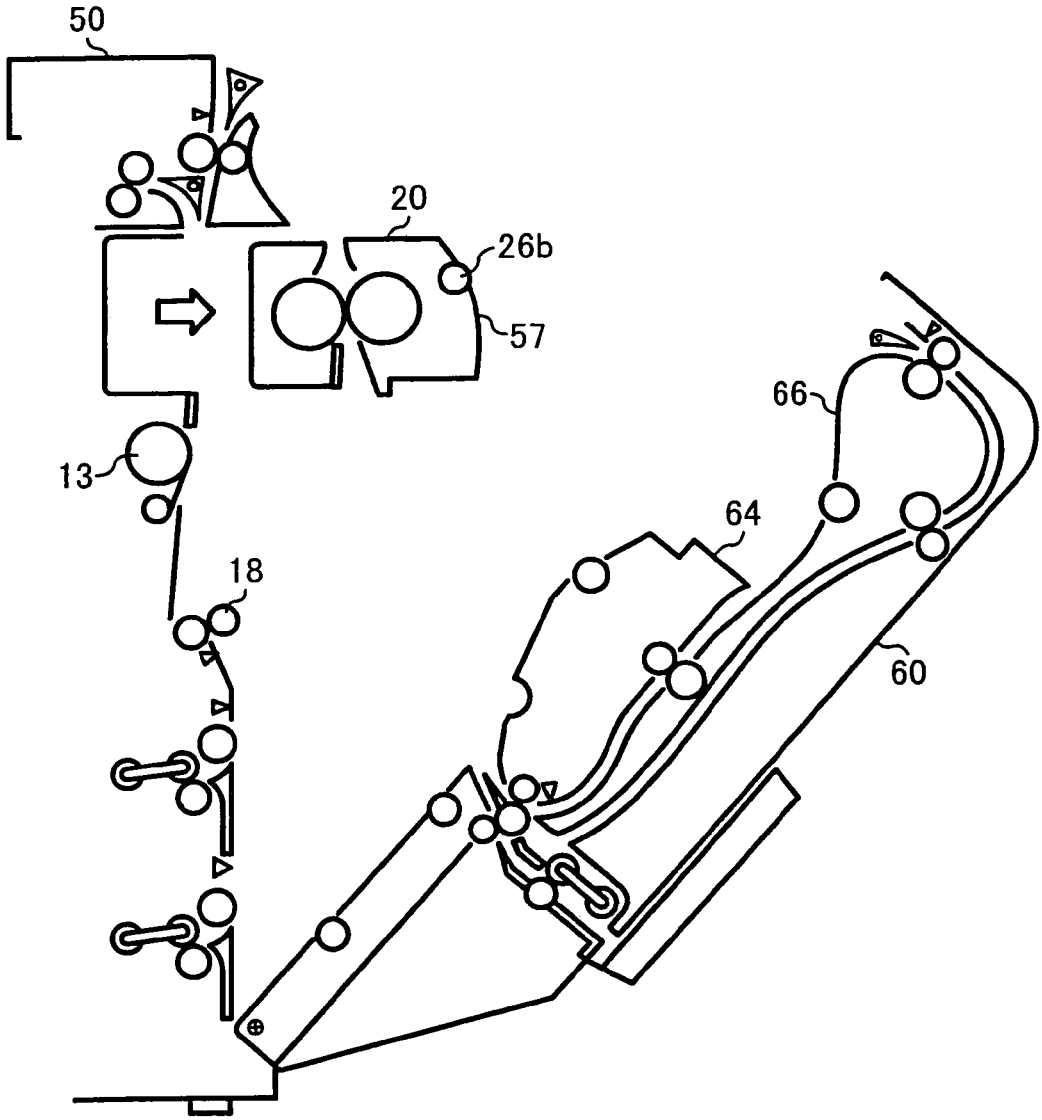
FIG. 13 is a partial cross section view of the duplex unit illustrating attachment and removal of the fixing unit.

As shown in FIG. 12, a side face (located on the side of the sheet re-feeding path 62) of the fixing unit 20 is configured as a conveyance guide face 57 including a plurality of ribs 57*a*. When the duplex unit 60 is in a closed state, the conveyance guide face 57 forms a part of the sheet re-feeding path 62 together with a guide member 66 located at a position opposing to the fixing unit 20 (see FIG. 13). A driven roller 26*b* of the pair of conveyance rollers 26 is attached to and supported by the conveyance guide face 57. Further, the conveyance guide face 57 is provided with two handles 58 for pulling out the conveyance guide face 57 arranged at respective ends in a longitudinal direction. The fixing unit 20 is provided with two retractable grips 59 in a longitudinal direction on a top face thereof. In the full color printer 100, as the fixing unit 20 is installed in the body 50 in a removable manner, the handles 58 are used to remove the fixing unit 20 from the body 50. Further, as the removed fixing unit 20 may be held at the unfolded grips 59, the fixing unit 20 is easily handled. Further, as a housing of the fixing unit 20 (the conveyance guide face 57) is formed as a part of a guide member included in a sheet conveyance path, a reduced number of parts may achieve a cost reduction.

Next, another non-limiting embodiment of the present invention is described below referring to FIGS. 14 and 15. In the exemplary embodiment of FIGS. 14 and 15, the present invention is applied to an image forming apparatus in which the plurality of image forming unit are arranged along a sheet conveyance path, and a method of directly transferring toner images from respective image forming units onto a conveyed sheet is adopted. The same or equivalent parts as the parts included in the above embodiment are assigned with the same reference numerals, and redundant descriptions are omitted.

Figure 14:
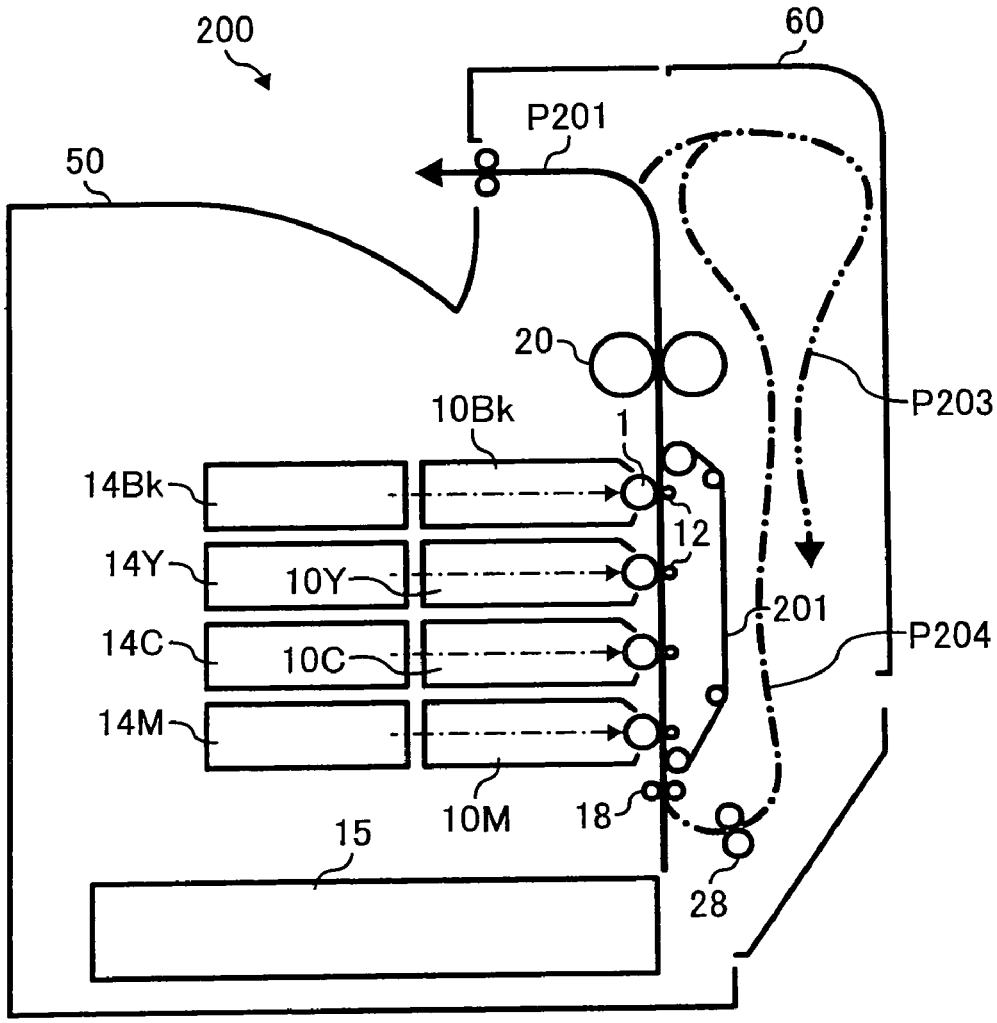
FIG. 14 is a schematic illustration of a configuration of a full color printer according to a second embodiment of the present invention.

FIG. 14 schematically illustrates a configuration of a full color printer 200 according to one non-limiting embodiment of the present invention. In the embodiment shown in FIG. 14, the four image forming units 10Y, 10C, 10M, and 10Bk (collectively referred to as the four image forming units 10) are vertically arranged in a substantially center area of the body. Four optical writing units 14Y, 14C, 14M, and 14Bk (collectively referred to as the four optical writing units 14) are provided at left sides of the four image forming units 10 in FIG. 14 so that photoconductor drums 1 in the respective image forming units 10 are irradiated with light emitted from the optical writing units 14. Further, a conveyance belt 201 is arranged at a position opposed to the photoconductor drums 1 in the image forming units 10. The conveyance belt 201 is internally provided with transfer rollers 12 arranged at positions opposing to the respective photoconductor drums 1.

In the embodiment shown in FIG. 14, when a single-sided image forming operation is performed, a sheet fed from a sheet feeding unit 15 is moved with predetermined timing by the pair of registration rollers 18. As the sheet is conveyed while being held by the conveyance belt 201 and the respective photoconductor drums 1, toner images in respective colors are directly transferred from the respective photoconductor drums 1 onto the sheet and superimposed thereon. After the toner images are transferred, toner is fixed onto the sheet by the fixing unit 20, and the sheet is discharged to a sheet discharge tray arranged on the top face of the full color printer 200. A sheet conveyance path in the case is indicated by a solid line P201 in FIG. 14.

The duplex unit 60 is internally provided with a switchback conveyance path and a sheet re-feeding path as described in the above embodiment. A sheet conveyance path in a case in which a sheet is carried into the switchback conveyance path is indicated by a chain double-dashed line P203 in FIG. 14. Further, a sheet conveyance path in a case in which a sheet is conveyed in the sheet re-feeding path is indicated by an alternate long and short dashed line P204 in FIG. 14. The sheet re-feeding roller 28 is arranged in a lower part of the duplex unit 60 so that the sheet is re-fed to the pair of registration rollers 18 from the sheet re-feeding path. Although conveyance rollers and sensors are arranged in each of the sheet conveyance paths as in the above embodiment, descriptions and illustrations thereof are omitted.

Figure 15:
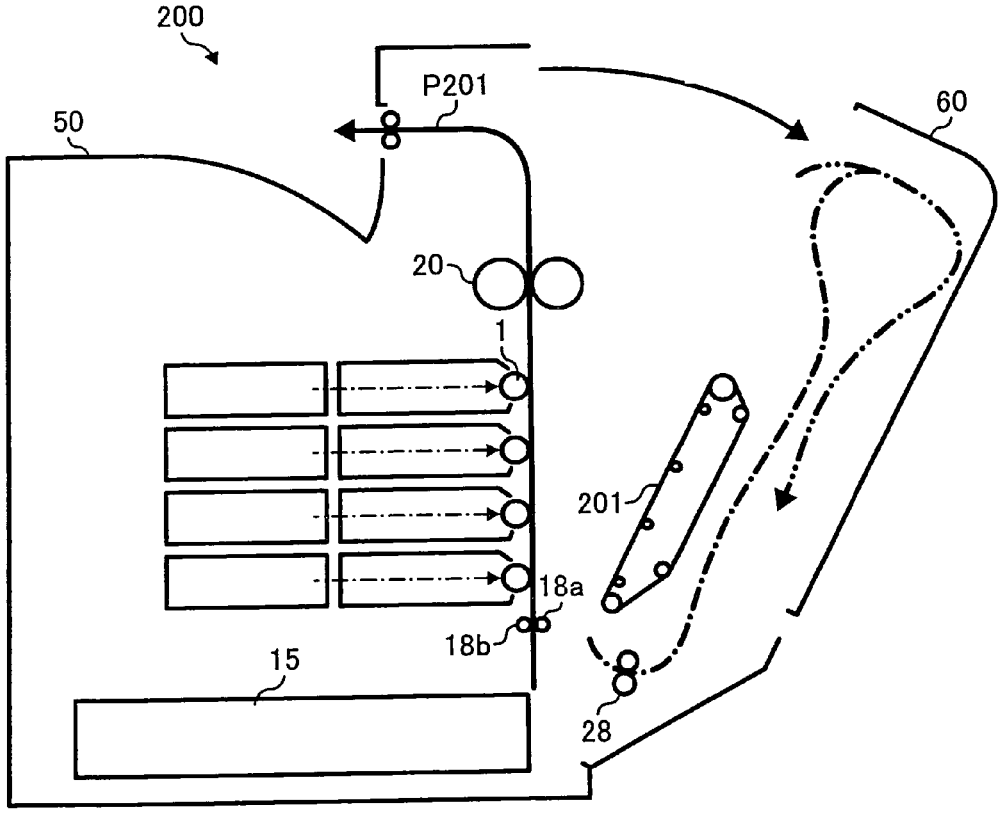
FIG. 15 is a schematic illustration of the full color printer shown in FIG. 14 with a duplex unit opened.

FIG. 15 schematically illustrates the full color printer 200 with the duplex unit 60 opened. As shown in FIG. 15, when the duplex unit 60 is opened, press-contact of the respective photoconductor drums 1 arranged in the sheet conveyance path with the conveyance belt 201 is released.

In the embodiment shown in FIG. 15, as in the above embodiment, the registration drive roller 18*a* included in the pair of registration rollers 18 is provided with the lever 71 described referring to FIGS. 4 and 5, and the pair of registration rollers 18 is allowed to reversely rotate at the angle of θ degrees. Therefore, even when a jammed sheet extends over the pair of registration rollers 18 and the sheet re-feeding roller 18 and is held thereby, the duplex unit 60 is easily opened so as to perform a jam clearance operation. In that case, as the pair of registration rollers 18 is allowed to reversely rotate, opening the duplex unit 60 does not require excessive force, and the jammed sheet P is prevented from being ripped.

The configuration described above referring to FIG. 10 may be adopted to cause the pair of registration rollers 18 to reversely rotate. Further, the full color printer 200 may also include a manual sheet feeding tray (description thereof is omitted) as in the above-described embodiment. In that case, as the pair of registration rollers 18 is allowed to reversely rotate at a predetermined angle even when a sheet fed from the manual sheet feeding tray is jammed by being held by a manual sheet feeding roller or the sheet re-feeding roller 28 and the pair of registration rollers 18, the duplex unit 60 may be easily opened to perform the jam clearance operation.

The present invention is not limited to the above embodiments. A mechanism for allowing the pair of registration rollers 18 to reversely rotate may adopt other appropriate configurations. Further, the distance in which a sheet is reversely conveyed by reverse rotation of the pair of registration rollers 18 may be appropriately set as desired. For example, the distance may be set according to an amount (angle) of reverse rotation of the pair of registration rollers 18 or according to a diameter thereof.

Further, the present invention may be applied to a monochrome apparatus including a single image bearing member, or to a color apparatus including a plurality of development units arranged around a single image bearing member. of course, the image forming apparatus is not limited to a printer. The image forming apparatus may be a copier, a facsimile, or a multifunction apparatus having a plurality of functions.

Further, an image forming method is not limited to an electronographic method. The present invention may be applied to an apparatus adopting any image forming method.

For example, when the present invention is applied to an image forming apparatus adopting an ink jet method, the lever 71 or the lever 171 may be arranged on a sheet conveyance roller located upstream of a recording part of a print head (in a sheet conveyance direction) so as to regulate an amount of reverse rotation of the sheet conveyance roller. As a result, when a jammed sheet is pulled in an upstream direction, or when the jammed sheet is pulled in the upstream direction due to opening of a duplex unit or a manual sheet feeding unit, the sheet conveyance roller is prevented from being stained with ink dripped on the sheet from the recording part.

Further, a pair of rollers which are allowed to reversely rotate in a predetermined amount may open not only when a sub-unit such as a duplex unit and a manual sheet feeding unit is opened, but also at any one given point in time (irrespective of opening and closing of the sub-unit). In the case, the pair of rollers may reversely rotate when the sub-unit is opened, and the same effect as the effects of the above embodiments may be achieved.

The invention claimed is:

1. An image forming apparatus, comprising:

a body;

a sheet conveyance path;

a sub-unit configured to be released from the body;

a first pair of rollers configured to rotate in a first direction to convey a sheet in a downstream direction of the sheet conveyance path by holding the sheet, the first pair of rollers configured to rotate in a second direction opposite to the first direction, by a limited, predetermined rotation amount;

a second pair of rollers disposed upstream of the first pair of rollers in the sheet conveyance path, the second pair of rollers configured to convey the sheet and configured to hold the sheet; and a third pair of rollers disposed downstream of the first pair of rollers in the sheet conveyance path, the third pair of rollers configured to rotate in a first direction to convey the sheet in a sheet conveyance direction through the sheet conveyance path by holding the sheet, wherein, when the sheet is jammed in the first pair of rollers, the first pair of rollers is restricted from being rotated toward the upstream direction and the second pair of rollers does not rotate even when the sheet stretches toward the downstream direction, wherein the first pair of rollers rotates in the second direction by the limited, predetermined rotation amount when the second pair of rollers is upstream relative to the first pair of rollers while the sheet is held in the first pair of rollers and is disposed between the first pair of rollers and the second pair of rollers, wherein when the second pair of rollers is displaced in the upstream direction, the third pair of rollers is separated, and wherein the first pair of rollers is a registration roller pair, the third pair of rollers is a transfer roller pair, and a distance in which the sheet is reversely conveyed when the first pair of rollers rotates in the second direction by the predetermined rotation amount is set to be smaller than a distance between the registration roller pair and the transfer roller pair.

2. An image forming apparatus, comprising:

a body;

a sheet conveyance path;

a first pair of rollers configured to rotate in a first direction to convey a sheet in a sheet conveyance direction through the sheet conveyance path by holding the sheet, the first pair of rollers configured to rotate in a second direction opposite to the first direction by a limited, predetermined rotation amount; and a sub-unit configured to be released from the body and, during release, to cause a part of the sheet conveyance path upstream of the first pair of rollers to open, wherein the sub-unit includes a second pair of rollers configured to convey the sheet and configured to hold the sheet, wherein, when the sheet is stopped in a position extending over the first and second pairs of rollers, releasing the sub-unit from the body allows the first pair of rollers to rotate in the second direction, wherein the sub-unit includes a manual sheet feeding unit, and the second pair of rollers includes a manual sheet feeding roller, wherein the image forming apparatus is configured to form images with an electronographic method, wherein the first pair of rollers includes a pair of registration rollers.

3. The image forming apparatus according to claim 2, further comprising: a fixing unit configured to fix a toner image transferred onto a sheet and including a fixing roller, and a pressing roller in press-contact with the fixing roller, and wherein the fixing roller is configured to be released from press-contact with the pressing roller when the sub-unit is released from the body.

4. An image forming apparatus, comprising:

a body;

a sheet conveyance path;

a first pair of rollers configured to rotate in a first direction to convey a sheet in a sheet conveyance direction through the sheet conveyance path by holding the sheet, the first pair of rollers configured to rotate in a second direction opposite to the first direction by a limited, predetermined rotation amount; and a sub-unit configured to be released from the body and, during release, to cause a part of the sheet conveyance path upstream of the first pair of rollers to open, wherein the sub-unit includes a second pair of rollers configured to convey the sheet and configured to hold the sheet, wherein, when the sheet is stopped in a position extending over the first and second pairs of rollers, releasing the sub-unit from the body allows the first pair of rollers to rotate in the second direction, wherein the sub-unit includes a duplex reverse unit configured to reverse a sheet from a first side to a second side so as to permit image forming on the second side after image forming is performed on the first side, and the second pair of rollers includes a sheet re-feeding roller.

5. The image forming apparatus according to claim 4, wherein the sub-unit includes a manual sheet feeding unit.

6. An image forming apparatus, comprising:

a body;

a sheet conveyance path;

a first pair of rollers configured to rotate in a first direction to convey a sheet in a sheet conveyance direction through the sheet conveyance path by holding the sheet, the first pair of rollers configured to rotate in a second direction opposite to the first direction by a limited, predetermined rotation amount; and a sub-unit configured to be released from the body and, during release, to cause a part of the sheet conveyance path upstream of the first pair of rollers to open;

a one-way clutch attached to a shaft of one of the first pair of rollers;

a lever attached to the shaft of a first roller of the first pair of rollers through the one-way clutch, and configured to rotate between first and second positions to cause the first pair of rollers to rotate in the second direction with a limitation to the extent of the predetermined rotation amount, the lever being restricted in rotation in a forward direction when in the first position so as to restrict rotation of the first pair of rollers in the second direction;

a reverse rotation regulation member configured to contact the lever when the lever is in the second position so as to restrict rotation of the lever in a direction opposite to the forward direction, wherein a second roller of the first pair of rollers includes a shaft, and wherein the lever is restricted in further rotation in a forward direction when in the first position by the shaft of the second roller of the first pair of rollers.

7. The image forming apparatus according to claim 6, wherein the first roller of the first pair of rollers includes a drive roller.

8. The image forming apparatus according to claim 6, wherein the first roller of the first pair of rollers includes rubber.

9. The image forming apparatus according to claim 6, wherein a rotation area of the lever ranging between the first and second positions is located above the first pair of rollers.

10. The image forming apparatus according to claim 6, further comprising a sign, disposed on or close to the lever, indicating that the lever is a member to be operated by a user while the user performs a jam clearance operation.

11. The image forming apparatus according to claim 6, wherein the sub-unit includes a duplex reverse unit configured to reverse a sheet from a first side to a second side so as to permit image forming on the second side after image forming is performed on the first side.

12. The image forming apparatus according to claim 6, wherein the image forming apparatus is configured to form images with an ink jet method.

* * * * *